United States Patent [19]

Ohmura et al.

[11] 4,194,909

[45] Mar. 25, 1980

[54] FORGEABLE NICKEL-BASE SUPER ALLOY

[75] Inventors: Taizo Ohmura, Ohmiya; Akihiko Sakonooka, Ageo; Kensyo Sahira, Urawa; Noboru Yonezawa, Ohmiya, all of Japan

[73] Assignee: Mitsubishi Kinzoku Kabushiki Kaisha, Tokyo, Japan

[21] Appl. No.: 791,792

[22] Filed: Apr. 28, 1977

Related U.S. Application Data

[63] Continuation-in-part of Ser. No. 627,064, Oct. 30, 1975, abandoned.

[30] Foreign Application Priority Data

Nov. 16, 1974 [JP] Japan ..... 49-131571
Nov. 30, 1974 [JP] Japan ..... 49-136634

[51] Int. Cl.[2] ..... C22C 19/05
[52] U.S. Cl. ..... 75/171; 148/32
[58] Field of Search ..... 75/171, 170; 148/32, 148/32.5

[56] References Cited

U.S. PATENT DOCUMENTS 3,865,581 2/1975 Sekino et al. ..... 75/171
4,006,015 2/1977 Watanabe et al. ..... 75/171

*Primary Examiner*—R. Dean
*Attorney, Agent, or Firm*—Frishauf, Holtz, Goodman & Woodward

[57] ABSTRACT

A forgeable nickel-base super alloy free from cobalt and comprising the following essential constituent elements in weight percentage:

Carbon—0.04 to 0.25%;
Chromium—10.0 to 25.0%;
Tungsten—10.0 to 25.0%;
Aluminum—0.1 to 1.0%;
At least one element selected from the group consisting of 0.005 to 0.05% calcium, 0.001 to 0.02% magnesium and a 0.001 to 0.02% rare earth element—0.001 to 0.05%;

and

Nickel and other inevitable impurities—balance;

said forgeable nickel-base super alloy including a forgeable nickel-base super alloy added with, as required, the following additional elements in weight percentage in addition to the aforementioned essential elements:

Zirconium—0.005 to 0.1%;

and/or

At least one element selected from the group consisting of 0.1 to 3.0% niobium and 0.1 to 1.5% hafnium—0.1 to 3.0%.

6 Claims, 1 Drawing Figure

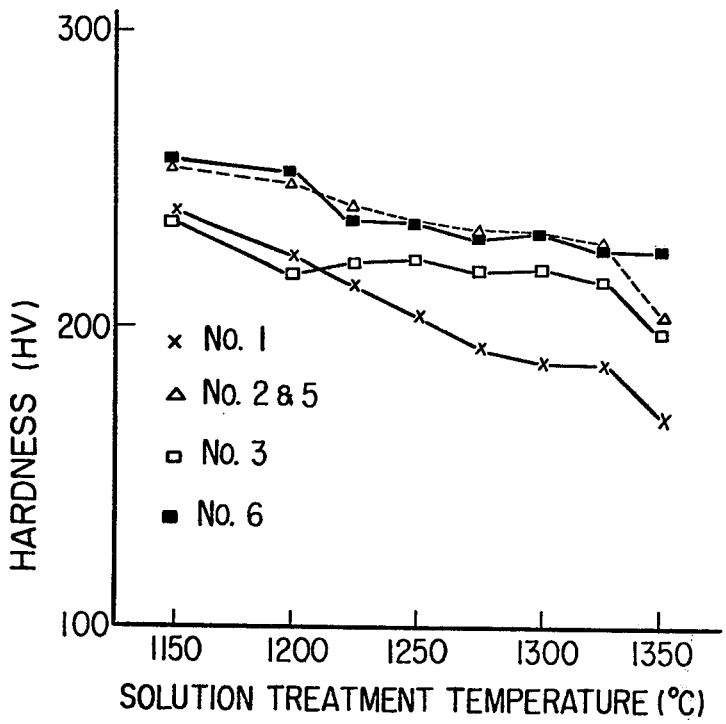
300
200
100
HARDNESS (HV)
× No. 1
△ No. 2 & 5
□ No. 3
■ No. 6
1150
1200
1250
1300
1350
SOLUTION TREATMENT TEMPERATURE (°C)

FORGEABLE NICKEL-BASE SUPER ALLOY

RELATED APPLICATION

This application is a continuation-in-part of application Ser. No. 627,064, filed Oct. 30, 1975, abandoned.

FIELD OF THE INVENTION

The present invention relates to a forgeable nickel-base super alloy free from cobalt, particularly to a forgeable nickel-base super alloy suitable for use as a structural material for a high temperature gas cooled reactor.

BACKGROUND OF THE INVENTION

Cobalt transforms into fission product $^{60}Co$ when exposed to radiation. Accordingly, it is desirable, from the viewpoint of safety, to use a super alloy free from cobalt or containing as little cobalt as possible for use in such portions of a high temperature gas cooled reactor where materials are exposed to radiation and members connected thereto.

However, most of the conventional super alloys having an extremely long creep rupture life at high temperatures of about 1,000° C. contain cobalt. On the other hand, the conventional super alloys free from cobalt usually have an insufficient creep rupture strength. Further, with conventional super alloys, inclusive or exclusive of cobalt, there are very few which have plastic formability sufficient to produce such products as bars, sheets, plates and pipes from the materials cast from such alloys.

Accordingly, a super alloy free from cobalt which has an excellent creep rupture strength at high temperatures of about 1,000° C. and a plastic formability over a wide range of temperatures and which is particularly suitable for use as a structural material for a high temperature gas cooled reactor has been desired, but no super alloys having such properties as mentioned above have been developed as yet.

SUMMARY OF THE INVENTION

Accordingly, it is an object of the present invention to provide a forgeable nickel-base super alloy free from cobalt.

It is another object of the present invention to provide a forgeable nickel-base super alloy having an excellent creep rupture strength at high temperatures of about 1,000° C.

Still another object of the present invention is to provide a forgeable nickel-base super alloy having an excellent plastic formability over a wide range of temperatures.

In particular, the principal object of the present invention is to provide a forgeable nickel-base super alloy suitable for use as a structural material for a high temperature gas cooled reactor.

In accordance with one of the features of the present invention, there is provided a forgeable nickel-base super alloy free from cobalt and comprising the following essential constituent elements in weight percentage:

Carbon—0.04 to 0.25%;
Chromium—10.0 to 25.0%;
Tungsten—10.0 to 25.0%;
Aluminum—0.1 to 1.0%;
At least one element selected from the group consisting of 0.005 to 0.05 calcium, 0.001 to 0.02% magnesium and a 0.001 to 0.02 rare earth element—0.001 to 0.005%;

and

Nickel and other inevitable impurities—balance

The super alloy of the present invention includes a forgeable nickel-base super alloy added with the following additional elements, as required, in addition to the aforementioned essential constituent elements:

Zirconium—0.005 to 0.1%;

and/or

At least one element selected from the group consisting of 0.01 to 3.0% niobium and 0.1 to 1.5% hafnium—0.1 to 3.0%.

BRIEF DESCRIPTION OF THE DRAWING

The FIGURE shows the relation between the solution treatment temperature and the hardness for the forgeable nickel-base super alloys of the present invention.

DETAILED DESCRIPTION OF PREFERRED EMBODIMENTS

In view of the foregoing, we have conducted an extensive study to develop a super alloy free from cobalt, which has an excellent creep rupture strength at high temperatures of about 1,000° C. and a plastic formability over a wide range of temperatures, and which is particularly suitable for use as a structural material for a high temperature gas cooled reactor, and as a result of this study, it has been proven that by adding the following elements in weight percentage to nickel as essential constituent elements, it is possible to obtain a forgeable nickel-base super alloy having the desired properties mentioned above:

Carbon—0.04 to 0.25%;
Chromium—10.0 to 25.0%;
Tungsten—10.0 to 25.0%;
Aluminum—0.1 to 1.0%;
At least one element selected from the group consisting of 0.005 to 0.05% calcium, 0.001 to 0.02% magnesium and a 0.001 to 0.02% rare earth element—0.001 to 0.05%.

The super alloy comprising the aforementioned constituents is hereinafter referred to as "First Alloy" of the present invention.

Furthermore, it is possible to further improve the creep rupture life at high temperatures of the First Alloy by adding the following additional element in weight percentage to the constituents of said First Alloy:

Zirconium—0.005 to 0.1%.

The super alloy comprising the constituents which are obtained by adding zirconium in the aforementioned percentage to the constituents of said First Alloy is hereinafter referred to as "Second Alloy" of the present invention.

It is also possible, as in the case of said Second Alloy, to further improve the creep rupture life at high temperatures of said First Alloy by adding the following additional elements in weight percentage to the constituents of said First Alloy:

At least one element selected from the group consisting of 0.1 to 3.0% niobium and 0.1 to 1.5% hafnium—0.1 to 3.0%.

The super alloy comprising the constituents which are obtained by adding niobium in the aforementioned weight percentage and/or hafnium in the aforementioned weight percentage to the constituents of said First Alloy is hereinafter referred to as "Third Alloy" of the present invention.

Furthermore, it is possible to further improve the creep rupture life at high temperatures of said First Alloy also by adding to the constituents of said First Alloy zirconium in the aforementioned weight percentage, and niobium and/or hafnium in the aforementioned weight percentage. The super alloy comprising the constituents which are obtained by adding zirconium in the aforementioned weight percentage and niobium and/or hafnium in the aforementioned weight percentage to the constituents of said First Alloy is hereinafter referred to as "Fourth Alloy" of the present invention.

The reasons why the ranges of constituents of the forgeable nickel-base super alloy of the present invention are limited as mentioned above are given in the following.

(1) Carbon

Carbon contributes to the strengthening of an alloy a it partially forms a solid solution state in the alloy base. It also contributes to the stabilization of the metallographical structure as another part precipitates as carbides. It has been confirmed that carbon in the super alloy of the present invention forms a solid solution state in the alloy base to an extent of about 0.04 Wt. % at a solution treatment temperature of 1,300° C. It is necessary, therefore, to have the alloy contain at least 0.04 Wt. % carbon for strengthening the alloy base and stabilizing the metallographical structure thereof. On the other hand, the plastic formability of an alloy is impaired when the carbon content exceeds 0.25 Wt. % because the hardness of alloy increases with the carbon content. The carbon content is therefore limited to 0.04 to 0.25 Wt. % in the present invention.

(2) Chromium

Chromium contributes to the improvement of the oxidation resistance of an alloy. However, if the chromium content is under 10.0 Wt. %, a desired oxidation resistance cannot be obtained. It is therefore necessary to have the alloy contain at least 10.0 Wt. % chromium. On the other hand, however, if the chromium content is over 25.0 Wt. %, this tends to form intermetallic compounds, thus making the alloy more brittle. Consequently, considering the quantities of the other elements contained such as tungsten, as described later, as well as the solid solution strengthening ability of chromium which is not so high, the upper limit of the chromium content is set out as 25.0 Wt. %.

(3) Tungsten

Tungsten greatly contributes to the strengthening of a solid solution, because of the formation of substantial solid solution in nickel. It also serves to stabilize the metallographical structure, because of the precipitation of carbides which are rather stable. With a tungsten content of under 10.0 Wt. %, however, a desired solution strengthening ability and a stable metallographical structure cannot be obtained. It is therefore necessary to have the alloy contain at least 10.0 Wt. % tungsten. With a tungsten content of over 25.0 Wt. %, on the other hand, the plastic formability of an alloy at high temperatures deteriorates seriously. The upper limit of the tungsten content is therefore set at 25.0 Wt. %.

(4) Aluminum

Aluminum serves as a deoxidizer. However, because a content of aluminum of under 0.1 Wt. % gives only an insufficient deoxidation of an alloy, the aluminum content should be at least 0.1 Wt. %. On the other hand, if an alloy has an aluminum content of over 1.0%, the selective oxidation is accelerated on the grain boundaries of the alloy in heating to a high temperature in a gaseous helium atmosphere with a low oxygen concentration, and at the same time, the plastic formability of the alloy is degraded. The content of aluminum should not therefore exceed the aforementioned upper limit.

(5) Calcium, magnesium and rare earth metals

Calcium, magnesium and rare earth metals have a function to desulphurize a molten alloy and thus directly or indirectly strengthen the grain boundaries of the alloy. In singly employing any of these elements, however, a desired effect as described above cannot be obtained with a calcium content of under 0.005 Wt. %, a magnesium content of under 0.001 Wt. %, or a rare earth metal content of under 0.001 Wt. %. The content of any of these elements in this case should therefore be over said lower limits. Also in this case, on the other hand, a calcium content of over 0.05 Wt. %, a magnesium content of over 0.02 Wt. % or a rare earth metal content of over 0.02 Wt. % results in a lower weldability of the alloy. The content of any of these elements should not therefore exceed said upper limits. For these reasons, the content of at least one of these elements is set at 0.001 to 0.05 Wt. %.

(6) Zirconium

Zirconium is not an essential constituent element of the forgeable nickel-base super alloy of the present invention. When it is desired to further improve the creep rupture life at high temperatures of the super alloy of the present invention, however, it is advisable to add zirconium to said super alloy. A zirconium content of under 0.005 Wt. %, however, does not bring about a remarkable improvement in the aforementioned ability. It is therefore necessary that the alloy contain at least 0.005 Wt. % zirconium. Since the weldability of an alloy is seriously impaired with a zirconium content of over 0.1 Wt. %, on the other hand, an upper limit of 0.1 Wt. % is set for the zirconium content.

(7) Niobium and hafnium

Niobium and hafnium are not essential constituent elements of the forgeable nickel-base super alloy of the present invention. As in the case of zirconium mentioned above, the addition of niobium and/or hafnium permits further improvement of the creep rupture life at high temperatures of the super alloy of the present invention. However, because no remarkable improvement is obtained in said ability with a content of niobium and/or hafnium of under 0.1 Wt. %, the content of niobium and/or hafnium should be at least 0.1 Wt. %. On the other hand, a niobium content of over 3.0 Wt. % causes precipitation of precipitates other than carbides, and this rather reduces the creep rupture life. A hafnium content of even over 1.5 Wt. % does not bring about any remarkable improvement in the creep rupture life at high temperatures. The upper limit of the niobium and hafnium contents is therefore set at 3.0 Wt. % and 1.5 Wt. %, respectively.

The present invention is described below more in detail with reference to an illustrative example.

EXAMPLE

Materials were blended so as to give the final chemical compositions as shown in Table 1, and the resulting mixtures were melted in a high-frequency induction furnace under vacuum to cast into ingots. Said ingots were refined then by electroslag remelting. The refined ingots thus obtained were subjected to a soaking treatment by holding at 1,250° C. for 24 hours, and subjected to tests on the following items.

In Table 1, alloys Nos. 1 to 3 and 5 to 10 are super alloys within the scope of the present invention, whereas those of Nos. 11 to 16 are super alloys for comparison outside the scope of the present invention.

Table 1

| Test piece | No. | Chemical Composition (Wt. %) C | Cr | W | Al | Ca | Mg | Ce | Zr | Nb | Hf | Ni |
|---|---|---|---|---|---|---|---|---|---|---|---|---|
| | 1 | 0.16 | 19.8 | 15.1 | 0.21 | 0.038 | 0.001 | — | — | — | — | Bal. |
| Super | 2 | 0.18 | 20.1 | 20.0 | 0.19 | 0.040 | — | — | — | — | — | " |
| alloy | 3 | 0.09 | 19.8 | 19.7 | 0.17 | 0.027 | 0.003 | — | — | — | — | " |
| of | 5 | 0.17 | 19.9 | 20.1 | 0.20 | — | — | 0.018 | — | — | — | " |
| the | 6 | 0.18 | 20.2 | 19.8 | 0.19 | 0.035 | — | — | 0.05 | — | — | " |
| present | 7 | 0.17 | 19.8 | 20.1 | 0.20 | 0.037 | — | — | — | 1.0 | — | " |
| invention | 8 | 0.19 | 20.1 | 20.2 | 0.18 | 0.035 | — | — | 0.05 | 2.0 | — | " |
| | 9 | 0.06 | 15.1 | 20.1 | 0.20 | 0.036 | — | — | 0.05 | 2.0 | — | " |
| | 10 | 0.09 | 20.0 | 20.1 | 0.19 | 0.036 | — | — | 0.05 | — | 1.0 | " |
| Super | 11 | 0.09 | 6.0 | 20.0 | 0.18 | 0.032 | — | — | — | — | — | " |
| alloy | 12 | 0.22 | 20.3 | 20.3 | 0.20 | 0.034 | — | — | — | 4.0 | — | " |
| for | 13 | 0.03 | 6.0 | 20.3 | 0.19 | — | — | — | 0.05 | 2.0 | — | " |
| comparison | 14 | 0.07 | 20.0 | 20.2 | 0.18 | — | — | — | 0.04 | 2.0 | — | " |
| | 15 | 0.08 | 19.8 | 19.8 | 0.21 | — | — | — | 0.04 | — | 2.0 | " |
| | 16 | | | | | Hastelloy - X | | | | | | |

(1) Test on forgeable temperature range

Round bar test pieces Nos. 1 to 3 and 5 to 10 having a diameter of 7 mm. and a length of 12 mm. were cut out respectively from the refined ingots representing alloys Nos. 1 to 3 and 5 to 10 of the present invention shown in Table 1, after the aforementioned soaking treatment. Said test pieces were heated to temperatures set at intervals of 25° C. between 1,100° C. and 1,350° C. For each of these temperatures, said heated test pieces were subjected to an upset forging test in which said test pieces were upset from a length of 12 mm. into a length of 6 mm. at a constant strain rate of 10/sec., with the use of a Kamplast meter.

In said forging test, cracks occurred in test pieces Nos. 1 to 3 and 5 of said First Alloy of the present invention and in test piece No. 6 of said Second Alloy of the present invention at 1,100° C., 1,125° C., and 1,350° C., but no crack was caused in the temperature range of 200° C. from 1,150° C. to 1,325° C. Cracks occurred in test piece No. 7 of said Third Alloy of the present invention and in test pieces Nos. 8 to 10 of said Fourth Alloy of the present invention at 1,325° C. and 1,350° C., but no crack was caused in the temperature range of 200° C. from 1,100° C. to 1,300° C.

Based on the results of said forging test, refined ingots Nos. 1 to 3 and 5 to 10 of the super alloys of the present invention were heated to 1,250° C., hot forged and hot rolled to manufacture 10 mm. thick plates. The plates thus obtained were free from cracks and caused no difficulty during said processing.

As shown above, the super alloys of the present invention have a wide forgeable temperature range of 200° C. in spite of the relatively high tungsten content, and said temperature range compares well with that of Hastelloy-X, a famous forgeable super alloy with a low tungsten content.

Then, test pieces were cut out from the 10 mm. thick plates of alloys Nos. 1 to 3, 5 and 6 of the present invention, and solution-treated by heating for 1 hour to temperatures set at intervals of 25° C. between 1,150° C. and 1,350° C., to measure the hardness (HV) at room temperature. The results obtained are shown in the FIGURE. As shown in this FIGURE, alloys Nos. 1 to 3, 5 and 6 of the present invention show a substantially constant hardness over a wide range of solution treatment temperatures from 1,200° C. to 1,350° C. This suggests that alloys Nos. 1 to 3, 5 and 6 of the present invention have a very stable metallographical structure. Also for alloys Nos. 7 to 10 of the present invention, the results obtained are substantially the same as those given above for alloys Nos. 1 to 3, 5 and 6 of the present invention.

In view of the above-mentioned results of measurement of the hardness at room temperature, and the results of observation of the metallographical structure of the super alloys, test pieces cut out from the 10 mm. thick plates, obtained in the manner as mentioned above, of alloys Nos. 1 to 3 and 5 to 10 of the present invention were respectively heated within a temperature range of from 1,150° C. to 1,325° C. for 1 to 8 hours for a solution treatment so as to give a grain size corresponding to ASTM No. 4. In general, a larger crystal grain leads to a longer creep rupture life, while the other properties such as the rupture elongation and the fatigue strength deteriorate. This is why ASTM No. 4 was employed as the target value.

(2) Oxidation resistance test

Test pieces were cut out from the hot rolled plates of alloys Nos. 1 to 3, 5 and 6 of the present invention; alloy No. 11, serving as an alloy for comparison, outside the scope of the present invention, having a low chromium content; and Hastelloy-X No. 16, also serving as an alloy for comparison, outside the scope of the present invention, which has a low cobalt content from among the conventional super alloys and is particularly believed to have excellent oxidation resistance as well as creep rupture strength, all these alloys being shown in Table 1. All of these test pieces were subjected to a solution treatment so as to give a grain size corresponding to ASTM No. 4. Said test pieces were then held for 50 hours at 1,000° C., 1,100° C. and 1,200° C., respectively, and the oxidation increments for said test pieces were measured. The results obtained are shown in Table 2.

Table 2

| Test piece | No. | Oxidation increment (mg/cm²/50 hrs) 1,000° C. | 1,100° C. | 1,200° C. |
|---|---|---|---|---|
| Super alloy | 1 | 0.027 | 0.268 | 3.83 |
| of the | 2 & 3 | 0.000 | 0.511 | 6.47 |
| Present | 5 | 0.000 | 0.432 | 3.82 |
| Invention | 6 | 0.002 | 0.530 | 6.32 |
| Super alloy | 11 | 12.870 | 16.590 | 36.93 |
| for | 16 | 0.560 | 0.460 | 17.46 |
| Comparison | | | | |

As shown in Table 2, alloy No. 11 outside the scope of the present invention with a low chromium content shows a very large oxidation increment at any of the heating temperatures and hence a low oxidation resistance. In contrast, alloys Nos. 1 to 3, 5 and 6 of the present invention all show a very high oxidation resistance.

Especially as compared with Hastelloy-X, there being no marked difference at 1,000° C. and 1,100° C., said alloys Nos. 1 to 3, 5 and 6 show an excellent oxidation resistance higher than that of Hastelloy at 1,200° C. Alloys Nos. 7 to 10 of the present invention, not shown in Table 2, also show a high oxidation resistance substantially identical with that of alloys Nos. 1 to 3, 5 and 6.

(3) Creep rupture test

Under the same conditions as those in the aforementioned oxidation resistance test, test pieces were prepared from alloys Nos. 1 to 3 and 5 to 10 of the present invention and alloys Nos. 11 to 16 outside the scope of the present invention, shown in Table 1, and subjected to a creep rupture test at high temperatures under the test conditions as shown in Table 3. The test results are also shown in Table 3.

As shown in Table 3, alloys Nos. 1 to 3 and 5 to 10 of the present invention show a very high creep rupture strength at high temperatures under all the test conditions as compared not only with alloys Nos. 11 and 13, serving as alloys for comparison, outside the scope of the present invention, having a low chromium content; but also with Hastelloy-X No. 16, also serving as an alloy for comparison, outside the scope of the present invention, having excellent properties as a super alloy for use in the manufacture of gas turbines, etc. In particular, Second Alloy No. 6 of the present invention containing zirconium, Third Alloy No. 7 of the present invention containing niobium and/or hafnium, and Fourth Alloys Nos. 8 to 10 of the present invention containing zirconium and niobium and/or hafnium show far more excellent creep rupture strengths at high temperature.

As described above in detail, according to the present invention, there are provided forgeable nickel base super alloys free from cobalt, excellent in creep rupture strength at high temperatures of about 1,000° C. and having excellent plastic formability over a wide temperature range, which are favorably suited for use as structural materials of a high temperature gas cooled reactor especially requiring materials free from cobalt and also as materials for parts and components exposed to very high temperatures, and thus an industrially useful effect is provided.

Table 3

| Test Conditions | Temp. Load | 1,000° C. 2.0 kg/mm² Life (hrs) | Elongation (%) | 3.5 kg/mm² Life (hrs) | Elongation (%) | 1,100° C. 1.0 kg/mm² Life (hrs) | Elongation (%) | 2.0 kg/mm² Life (hrs) | Elongation (%) |
|---|---|---|---|---|---|---|---|---|---|
| | | Test Results | | | | | | | |
| Test Piece Peice | No. | | | | | | | | |
| | 1 | 869.3 | 4.0 | 99.3 | 20.5 | 453.0 | 11.2 | 38.7 | 45.5 |
| Super | 2 | 835.0 | 24.4 | 100.2 | 18.7 | 428.3 | 19.7 | 83.0 | 38.2 |
| alloy | 3 | 498.4 | 27.8 | 81.5 | 30.3 | 290.3 | 34.4 | 60.8 | 25.0 |
| of the | 5 | 953.0 | 22.0 | 112.2 | 15.8 | 536.2 | 17.4 | 97.3 | 25.8 |
| Present | 6 | 2250.0 | 23.1 | 248.0 | 24.0 | 1253.0 | 15.8 | 130.1 | 20.4 |
| Invention | 7 | | | 282.2 | 61.2 | | | 105.7 | 58.4 |
| | 8 | | | 526.7 | 16.4 | | | 155.5 | 31.1 |
| | 9 | | | 300.1 | 54.5 | | | 153.0 | 48.5 |
| | 10 | | | 320.0 | 16.5 | | | 170.5 | 18.3 |
| Super | 11 | 54.0 | 11.4 | 2.5 | 10.3 | 38.0 | 15.3 | 0.4 | 8.4 |
| alloy | 12 | | | 70.4 | 113.0 | | | 26.0 | 63.2 |
| for | 13 | | | 52.7 | 20.5 | | | 25.7 | 21.3 |
| Comparison | 14 | | | 158.8 | 56.4 | | | 85.5 | 45.5 |
| | 15 | | | 150.3 | 16.5 | | | 41.3 | 20.5 |
| | 16 | 257.0 | 86.1 | 22.0 | 30.5 | 141.7 | 61.6 | 17.3 | 116.5 |

What is claimed is:

1. A forgeable nickel-base super alloy free of cobalt and titanium and consisting essentially of, in weight percent:

carbon—0.11 to 0.25
chromium—10.0 to 25.0
tungsten—10.0 to 25.0
aluminum—0.1 to 1.0
at least one element selected from the group consisting of calcium, magnesium and rare earth metal—0.001 to 0.05, the minimum and maximum percentages of calcium (i), magnesium (ii) and rare earth metal (iii) being, respectively, (i) 0.005 and 0.05,
(ii) 0.001 and 0.02,
(iii) 0.001 and 0.02, and the balance nickel and incidental impurities.

2. The forgeable nickel-base super alloy of claim 1, also containing from 0.005 to 0.1 percent by weight of zirconium.

3. The forgeable nickel-base super alloy of claim 1, also containing from 0.1 to 3.0 percent by weight of at least one element selected from the group consisting of niobium and hafnium, the minimum and maximum percentages of niobium (iv) and hafnium (v) being, respectively, (iv) 0.1 and 3.0, (v) 0.1 and 1.5.

4. The forgeable nickel-base super alloy of claim 1, also containing from 0.1 to 3.0 percent by weight of at least one element selected from the group consisting of niobium and hafnium, the minimum and maximum percentages of niobium (iv) and hafnium (v) being, respectively, (iv) 0.1 and 3.0, (v) 0.1 and 1.5.

5. The forgeable nickel-base super alloy of claim 1, which also contains from 0.1 to 3.0% by weight of niobium.

6. The forgeable nickel-base super alloy of claim 2, which also contains from 0.1 to 3.0% by weight of niobium.

* * * * *

UNITED STATES PATENT AND TRADEMARK OFFICE

CERTIFICATE OF CORRECTION

PATENT NO. : 4,194,909

DATED : March 25, 1980

INVENTOR(S) : TAIZO OHMURA et al

It is certified that error appears in the above-identified patent and that said Letters Patent are hereby corrected as shown below:

Abstract, line 10: rewrite "elemen-" as --element--.

Abstract, line 11: delete "t".

Column 2, line 2: rewrite "0.005%" as --0.05%--.

Column 2, line 41: rewrite "elemen-" as --element--.

Column 2, line 42: delete "t".

Column 3, line 21: after "alloy", replace "a" with --as--.

Column 7, line 28 (Table 3): in the first column heading, after "Test Piece", delete "Peice".

Column 8, line 53 (Claim 1): rewrite "meta-" as --metal--.

Column 8, line 54: delete "1".

Column 9, line 7 (Claim 4): replace "claim 1" with --claim 2--.

Signed and Sealed this

*Fourth* Day of *November 1980*

[SEAL]

*Attest:*

SIDNEY A. DIAMOND

*Attesting Officer*

*Commissioner of Patents and Trademarks*